US011202966B2

(12) United States Patent
Faanes

(10) Patent No.: US 11,202,966 B2
(45) Date of Patent: Dec. 21, 2021

(54) SCULPTURE DEVICE MOUNTABLE TO ELECTRONIC DEVICE HAVING BUILT-IN CAMERA

(71) Applicant: Perry C. Faanes, Capistrano Beach, CA (US)

(72) Inventor: Perry C. Faanes, Capistrano Beach, CA (US)

( * ) Notice: Subject to any disclaimer, the term of this patent is extended or adjusted under 35 U.S.C. 154(b) by 261 days.

(21) Appl. No.: 16/601,579

(22) Filed: Oct. 14, 2019

(65) Prior Publication Data

US 2021/0106922 A1 Apr. 15, 2021

(51) Int. Cl.

| | |
|---|---|
| ***A63H 33/26*** | (2006.01) |
| ***A63H 33/42*** | (2006.01) |
| ***A63H 3/50*** | (2006.01) |
| ***A63H 7/02*** | (2006.01) |
| ***A63H 3/00*** | (2006.01) |
| ***A63H 33/00*** | (2006.01) |
| ***A63H 13/04*** | (2006.01) |

(52) U.S. Cl.

CPC ..... *A63H 3/003* (2013.01); *A63H 3/50* (2013.01); *A63H 13/04* (2013.01); *A63H 33/26* (2013.01)

(58) Field of Classification Search

CPC ..... A63H 3/00; A63H 3/003; A63H 3/005; A63H 3/50; A63H 13/04; A63H 17/25; A63H 33/00; A63H 33/26; A63H 33/42

USPC ..... 446/71, 72, 82, 83, 268, 279; 472/88, 89

See application file for complete search history.

(56) References Cited

U.S. PATENT DOCUMENTS

| | | | | | |
|---|---|---|---|---|---|
| 2,484,116 | A | | 10/1949 | Papke | |
| 3,244,468 | A | | 4/1966 | Meltzer | |
| 4,120,116 | A | * | 10/1978 | Williams | A63H 33/22 359/617 |
| 4,141,176 | A | * | 2/1979 | Flicker | A63H 3/20 446/359 |
| 4,192,580 | A | * | 3/1980 | Meyer | G02B 21/0008 359/801 |
| 4,804,348 | A | * | 2/1989 | Bondi' | A63H 13/04 446/352 |
| 5,013,278 | A | * | 5/1991 | Dixon | A63H 3/50 446/219 |
| 5,407,391 | A | | 4/1995 | Monroe | |
| 5,542,870 | A | | 8/1996 | Westersund | |
| 5,607,337 | A | * | 3/1997 | Callahan | A63H 3/003 434/155 |

(Continued)

OTHER PUBLICATIONS

Hog Wild Toys, Product Catalog, pp. 8-11, published Jan. 13, 2019.

*Primary Examiner* — Alexander R Niconovich

(57) ABSTRACT

A sculpture device has a base, a figurine, a control element, a cover, and a device attachment clip. The control element has a magnetic mechanism for moving the figurine along an upper surface of the base in correspondence with movement of the control element along a lower surface of the base. The cover is coupled to the base and encloses a device interior of the sculpture device. The device attachment clip is coupled to the cover and has a through-hole or a sculpture lens. The device attachment clip removably attaches the sculpture device to an electronic device in a manner such that the through-hole or the sculpture lens is aligned with a camera lens of the electronic device allowing an operator to view the figurine and the device interior on a display screen of the electronic device when the camera is activated.

20 Claims, 9 Drawing Sheets

(56) References Cited

U.S. PATENT DOCUMENTS 5,707,237 A 1/1998 Takemoto
5,848,029 A * 12/1998 Chang ..... G04B 45/04 368/229
6,056,618 A * 5/2000 Larian ..... A63H 3/003 446/268
6,071,167 A * 6/2000 Yang ..... A63H 33/005 446/236
6,131,318 A * 10/2000 Hsieh ..... G09F 19/08 40/406
6,350,174 B1 * 2/2002 Halford ..... A63H 18/028 446/444
6,383,429 B1 * 5/2002 Noto ..... B29C 39/10 264/134
6,540,580 B1 * 4/2003 Wolfram ..... A63H 1/30 446/250
6,773,344 B1 * 8/2004 Gabai ..... A63H 3/28 463/1
7,261,613 B1 * 8/2007 Hull ..... A63H 18/023 446/444
7,578,719 B1 * 8/2009 Faanes ..... B44C 5/005 446/129
7,942,719 B2 * 5/2011 Leynes ..... B62J 11/00 446/268
7,988,520 B2 * 8/2011 Faanes ..... B44C 5/005 446/219
8,827,760 B2 * 9/2014 Ushibo ..... A63H 3/003 446/73
9,415,319 B1 * 8/2016 Jarrett ..... A63H 18/02
2002/0086609 A1 * 7/2002 Donohoe ..... A63H 17/16 446/376
2007/0113306 A1 * 5/2007 Paci ..... A63H 3/005 455/575.1
2007/0197126 A1 * 8/2007 Derrah ..... A63H 7/00 446/288
2008/0032596 A1 * 2/2008 Sheltman ..... A63H 18/028 446/444
2010/0109279 A1 * 5/2010 Leynes ..... A63H 17/16 280/202
2016/0067628 A1 * 3/2016 Reid ..... A63H 33/22 446/484
2016/0228779 A1 * 8/2016 Honaker ..... A63H 3/003
2017/0246546 A1 * 8/2017 Brown, Sr. ..... A63H 3/02
2019/0336872 A1 * 11/2019 Brown, Sr. ..... A63H 3/005

* cited by examiner

SCULPTURE DEVICE MOUNTABLE TO ELECTRONIC DEVICE HAVING BUILT-IN CAMERA

FIELD

The present disclosure relates to a sculpture device having a figurine that is movable within the sculpture device via a magnetic mechanism that is manually movable along the lower surfaces of the sculpture device, and to a device attachment clip for removably coupling the sculpture device to an electronic device such as a cell phone.

BACKGROUND

Scale-model figures such as toy figures and action figures have long provided entertainment and amusement for people of all ages. For children, playing with toy figures may help develop the child's imagination. In some examples, a toy figure may be configured as a human actor that is movable along a miniaturized replica of a scene or environment of the type normally associated with the type of toy figure. For example, a toy figure may be configured as an individual on a skateboard riding on a miniaturized replica of a skateboard park or an empty swimming pool. The skateboard figure may be manipulated by an operator to perform tricks and maneuvers within or around the miniaturized replica of the skateboard park or swimming pool.

It would be desirable to be able to capture images and/or video of tricks and maneuvers performed by the figure for watching at a later time and for sharing with others.

BRIEF SUMMARY

The above-noted desire for the ability to capture images or video of the movements of a toy figure within an associated environment is specifically addressed by the present disclosure which provides a sculpture device that is removably attachable to an electronic device having a built-in camera, a camera lens, and a display screen. The sculpture device includes a base having a lower surface and an upper surface. In addition, the sculpture device includes at least one figurine that is movable along the upper surface. Furthermore, the sculpture device includes a control element having a magnetic mechanism that is magnetically attractable to the figurine for retaining the figurine against the upper surface and moving the figurine along the upper surface in correspondence with the manual movement of the control element along the lower surface. The sculpture device also includes a cover coupled to the base for enclosing a device interior of the sculpture device. Additionally, the sculpture device includes a device attachment clip coupled to the cover and the sculpture device has a through-hole or a sculpture lens. The device attachment clip is configured to removably attach the sculpture device to the electronic device in a manner such that the through-hole or sculpture lens is aligned with the camera lens thereby allowing an operator to view the figurine and the device interior on the display screen when the camera is activated.

In examples where the device attachment clip has a sculpture lens, the sculpture lens may be configured as a wide-angle lens and/or as a magnifying lens. In some examples, the electronic device may be a cell phone. In still further examples, the cover may be rotatably coupled to the base. In still further examples, the sculpture lens may be attached to the cover or to the base, or the sculpture lens may be coupled to or integrated into the device attachment clip which may be separately attached to the cover or to the base.

The features, functions and advantages that have been discussed can be achieved independently in various embodiments of the present disclosure or may be combined in yet other embodiments, further details of which can be seen with reference to the following description and drawings below.

BRIEF DESCRIPTION OF THE DRAWINGS

These and other features of the present invention will become more apparent upon reference to the drawings wherein like numbers refer to like parts throughout and wherein.

DETAILED DESCRIPTION

Figure 1:
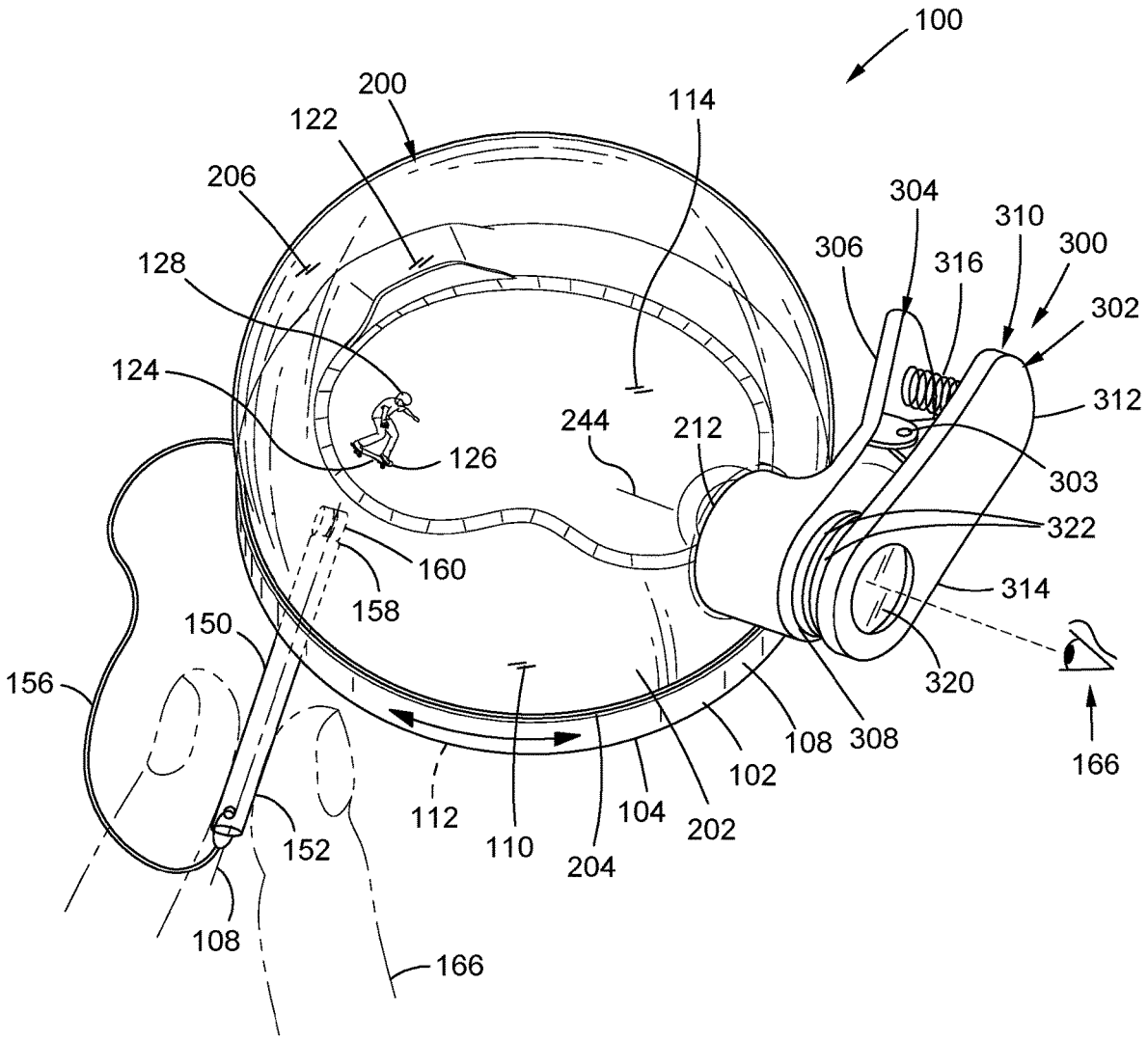
FIG. 1 is a perspective view of an example of a sculpture device having a cover coupled to a base having an upper surface representative of a swimming pool and further including a figurine representative of an individual on a skateboard being moved along the upper surface via a control element manually moved along a lower surface of the base, and further including a device attachment clip for removably coupling the sculpture device to an electronic device having a built-in camera.
Figure 2:
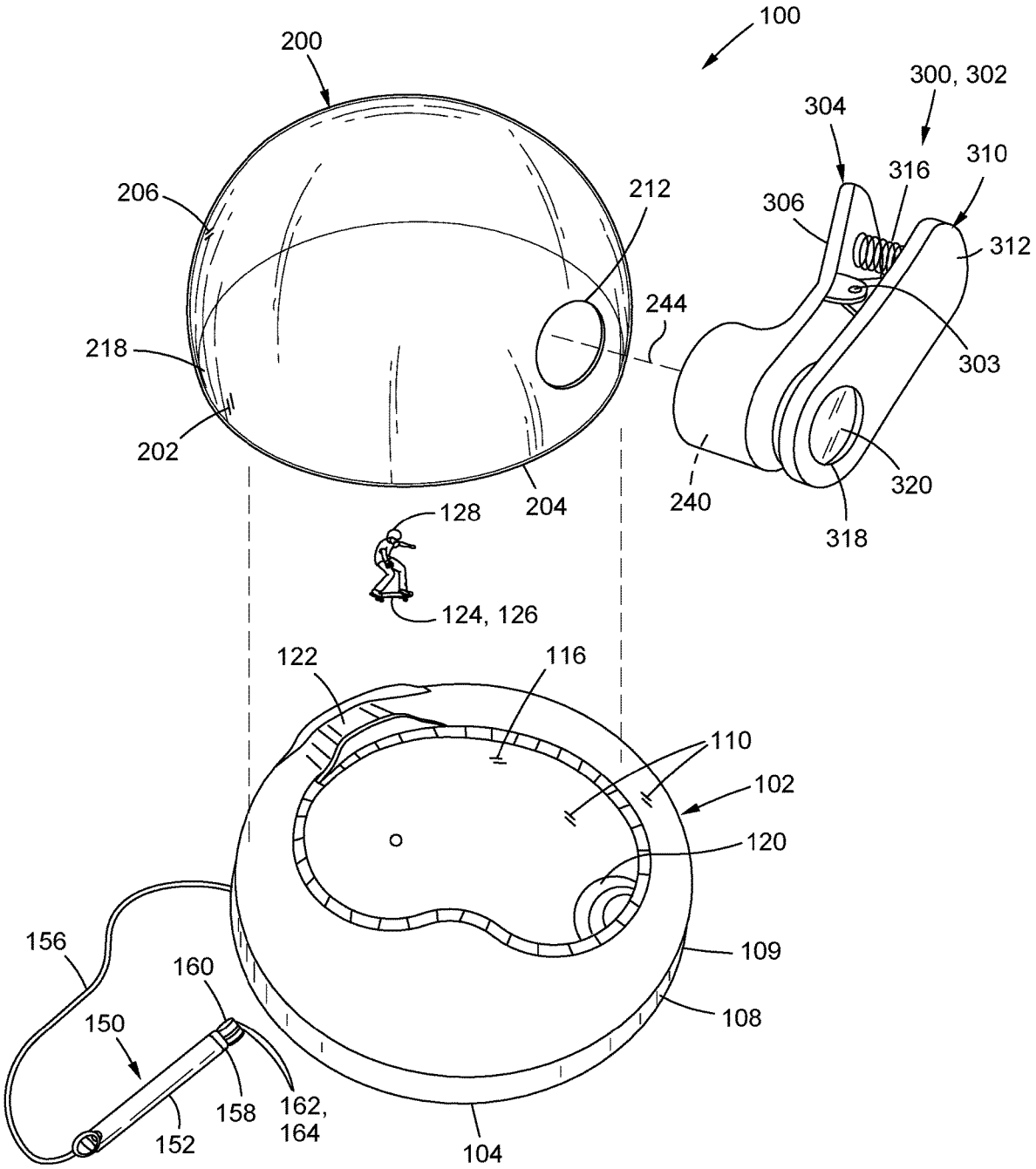
FIG. 2 is an exploded perspective view of the example of the sculpture device of FIG. 1 in which the device attachment clip is configured as a lever assembly.

Referring now to the drawings wherein the showings are for purposes of illustrating preferred and various embodiments of the disclosure, shown in FIGS. 1-5 is a perspective view of an example of a sculpture device 100 having a cover 200 coupled to a base 102. The base 102 and cover 200 collectively enclose a device interior 114 for containing at least one figurine 128 that is movable within the sculpture device 100 via a control element 150 as described below. The sculpture device 100 may include any one or more of the components and functionalities disclosed in U.S. Pat. No. 7,578,719 issued on Aug. 25, 2009, and entitled SCULPTURE METHOD UTILIZING NEW MEANS OF SIMULATING, VIEWING, AND DISPLAYING SPORTING, UNDERSEA AND OTHER ENVIRONMENTS, herein incorporated by reference in its entirety, and/or the sculpture device 100 may include any one or more of the components and functionalities disclosed in U.S. Pat. No. 7,988,520 issued on Aug. 2, 2011, and entitled SCULPTURE DEVICE, also herein incorporated by reference in its entirety.

Figure 8:
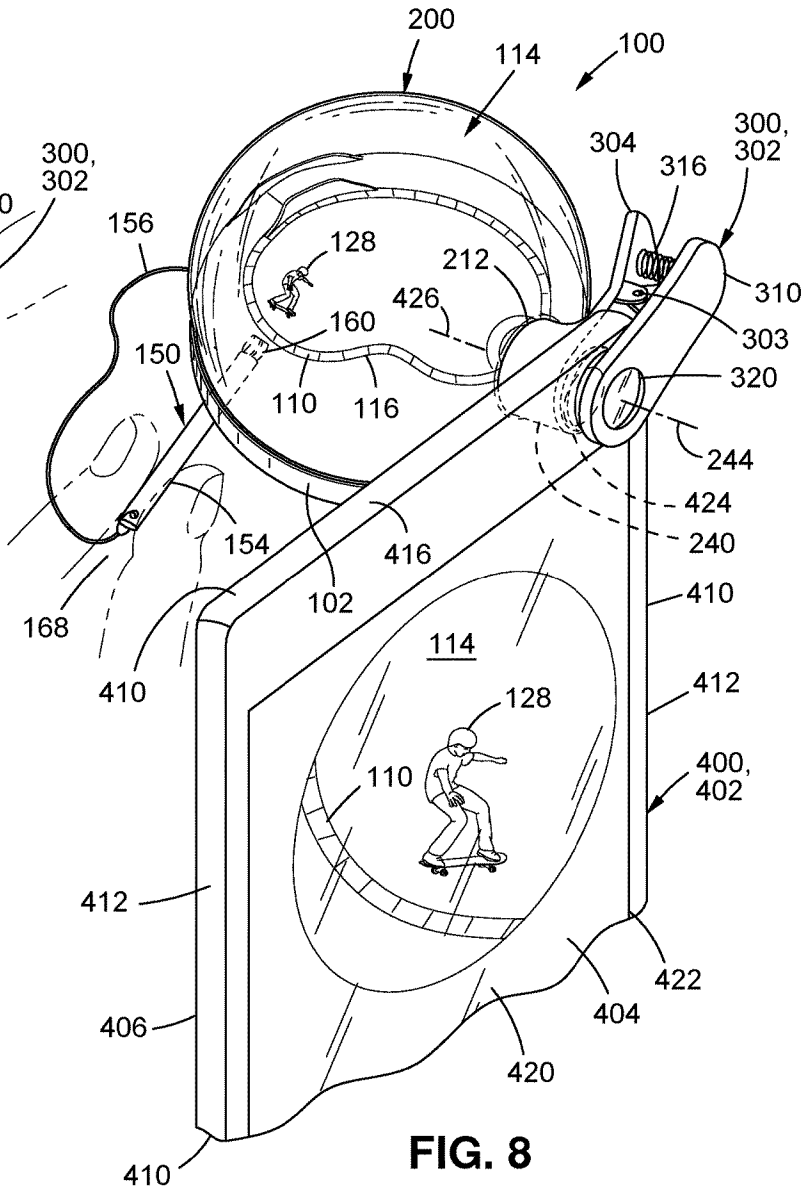
FIG. 8 shows the sculpture device of FIG. 7 removably coupled to the cell phone via the device attachment clip and illustrating a display screen on which an operator may view the movement of the figurine within the sculpture device.
Figure 7:
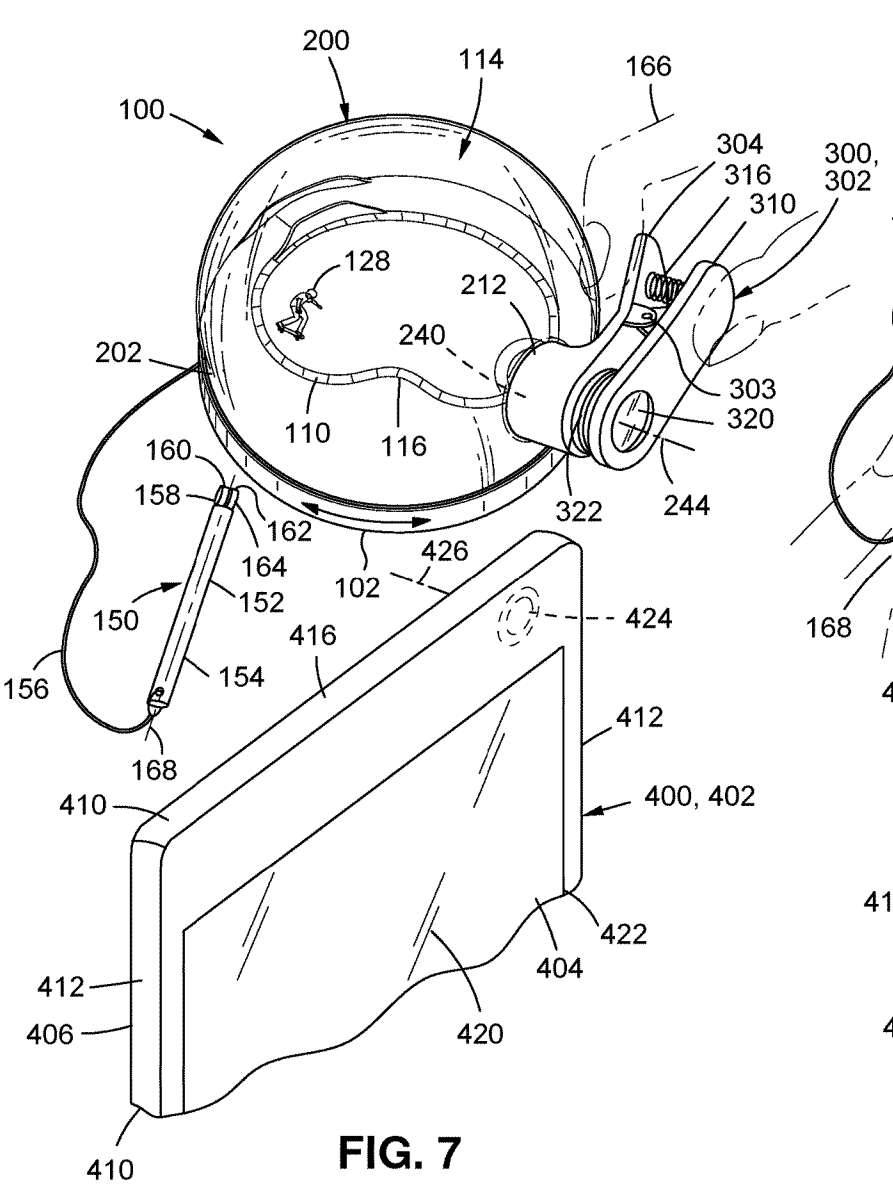
FIG. 7 is an exploded perspective view of an example of a sculpture device and a cell phone having a built-in camera.
Figure 15:
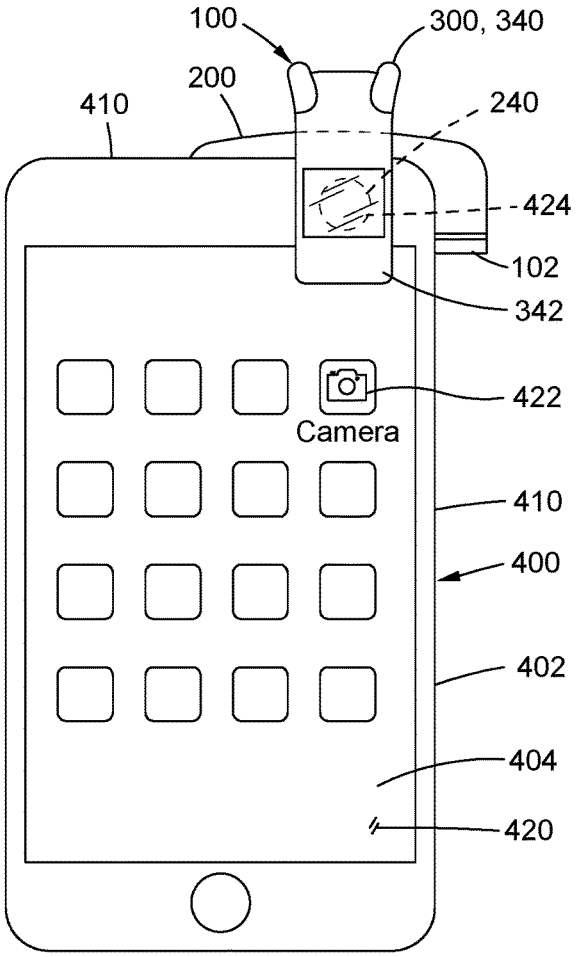
FIG. 15 is a front view of a cell phone to which the sculpture device is clamped in a manner such that the sculpture lens axis of the sculpture lens is aligned with a camera lens axis of the camera lens of the built-in camera of the cell phone.
Figure 16:
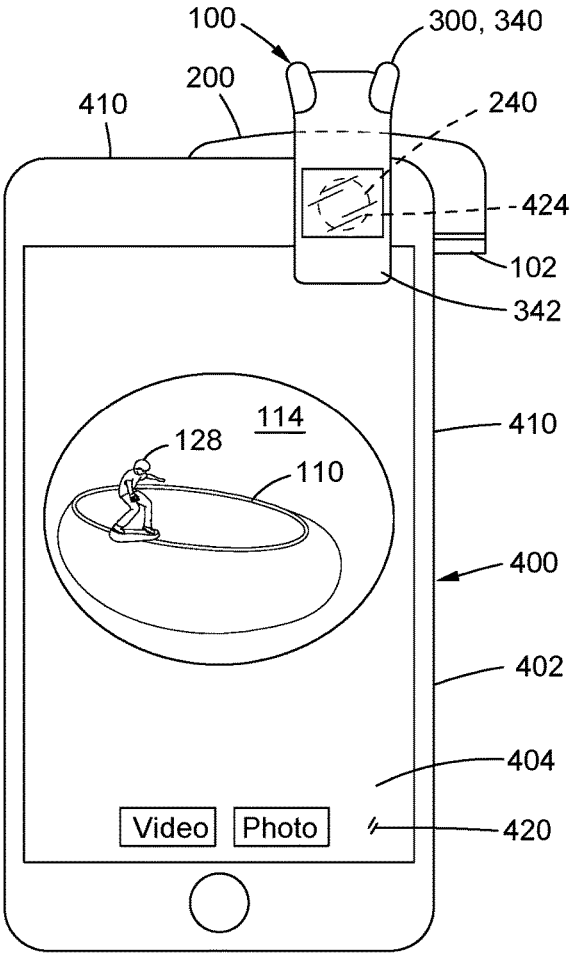
FIG. 16 is an additional front view of the cell phone of FIG. 15 showing the display screen of the cell phone showing an image of a figurine moving within the sculpture device.

The presently-disclosed sculpture device 100 may be of relatively small size. For example, the sculpture device 100 may have a width of less than 4 inches and a height of less than 2.5 inches although the sculpture device 100 may be provided in sizes larger than 4 inches wide and/or 2.5 inches high. The sculpture device 100 includes a device attachment clip 300 for removably coupling the sculpture device 100 to an electronic device 400 (e.g., a cell phone 402) having a built-in camera 422 and a display screen 420. The presently-disclosed sculpture device 100 may be of relatively light weight (e.g., less than 1 pound) such that when coupled to an electronic device 400 such as a cell phone 402 (e.g., see FIGS. 7-8), the combined weight of the cell phone 402 and the sculpture device 100 allows an operator 166 to easily hold the cell phone 402 with one hand and move the figurine 128 using the control element 150 (e.g., see FIG. 8) with the opposite hand while viewing the movement of the figurine 128 (FIG. 8) on the display screen 420 of the cell phone 402 when the built-in camera 422 is activated (e.g., see FIG. 15), as described below.

Figure 3:
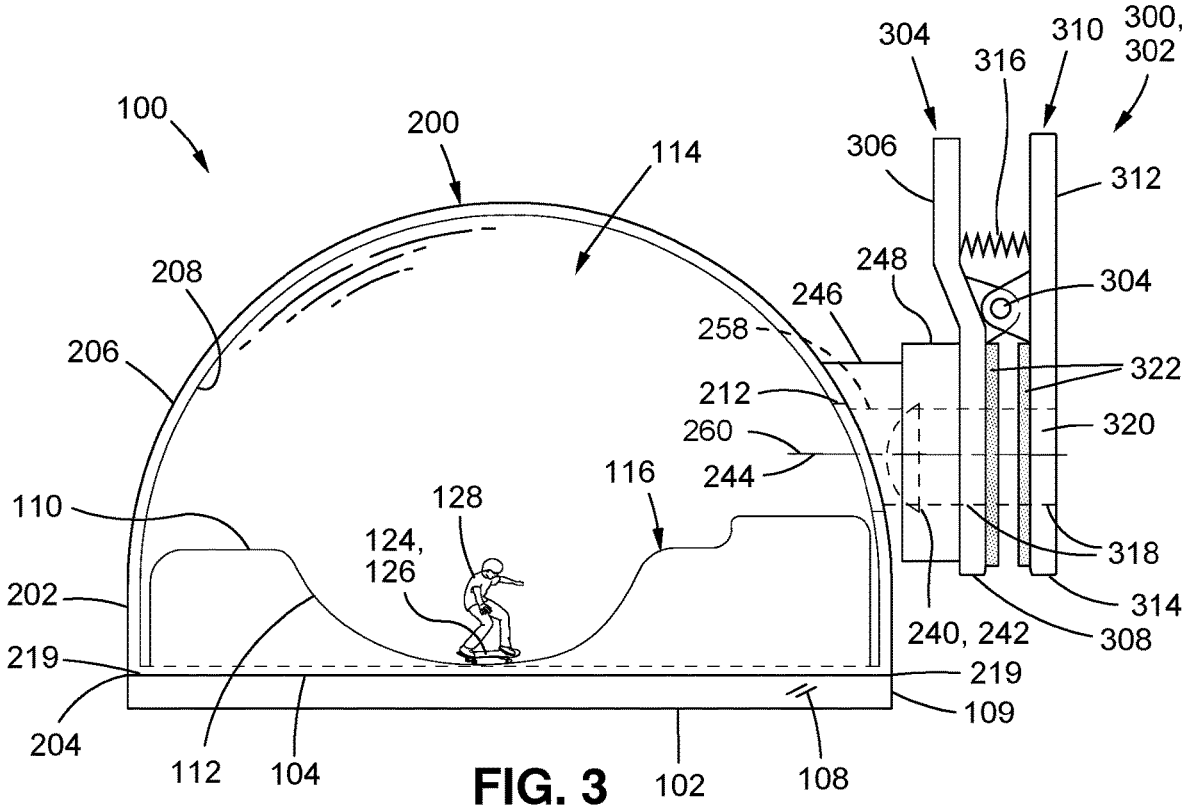
FIG. 3 is a side view of the example of the sculpture device of FIG. 1.
Figure 4:
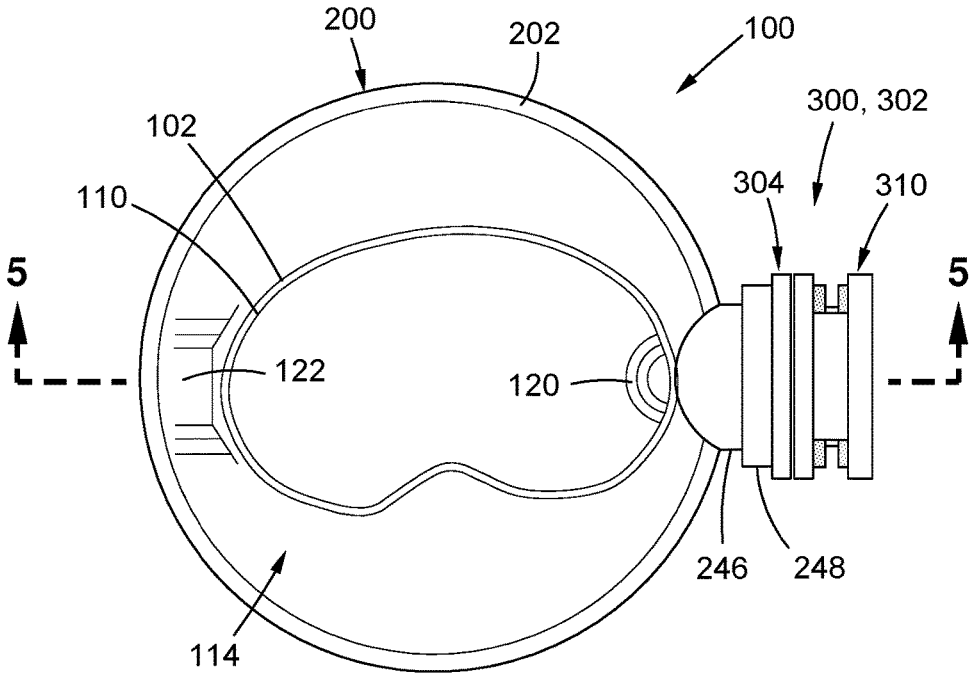
FIG. 4 is a top view of the example of the sculpture device of FIG. 1.

The sculpture device 100 includes a through-hole 258 or a sculpture lens 240. The through-hole 258 or the sculpture lens 240 may be included in or coupled to the device attachment clip 300 or to the cover 200. For example, FIG. 3 shows a sculpture lens 240 included with the device attachment clip 300. However, for examples where the built-in camera 422 of the electronic device 400 has a wide-angle camera lens (not shown), the sculpture device 100 may include a through-hole 258 in the device attachment clip 300, and the sculpture lens 240 may be omitted from the sculpture device 100. For examples where the electronic device 400 has a regular camera lens and not a wide-angle camera lens, the sculpture lens 240 may be configured as a wide-angle lens 242. A magnifying lens (not shown) may optionally be included with or integrated into the wide-angle lens 242 or may be a separate component arranged in parallel with the wide-angle lens 242. Alternatively, the sculpture lens 240 may be provided as a magnifying lens without a wide-angle lens 242.

The device attachment clip 300 may clamp the sculpture device 100 onto the electronic device 400 in a manner such that the through-hole axis 260 of the through-hole 258 or the sculpture lens axis 244 of the sculpture lens 240 is aligned with a camera lens axis 426 of a camera lens 424 of the built-in camera 422. As mentioned above and described in greater detail below, when the built-in camera 422 is activated, an operator 166 may view the device interior 114 and the movement of the figurine 128 on the display screen 420 of the electronic device 400. In addition, the operator 166 may record images and video of the movements of the figurine 128 for review at a later time and/or to share with others such as by electronic transmission via instant messaging and/or by posting on social media.

The base 102 has a lower surface 112, an upper surface 110, and a base side portion 109. The cover 200 may be generally hemispherically-shaped or dome-shaped and is configured to be coupled to the base 102 for enclosing the device interior 114 of the sculpture device 100. The cover 200 may include a cover side portion 202 which may be coupled to the base side portion 109. The cover 200 may be formed of plastic or glass and may be substantially transparent to allow for viewing of the device interior 114 including the upper surface 110 of the base 102 and the figurine 128. In some examples, the cover 200 may be formed of magnifying sheet material. For example, the cover 200 may be formed as a Fresnel lens molded into the dome shape of the cover 200, and may be configured such that substantially the entire transparent cover 200 provides magnification of up to 2-3 times the actual size of the figurine 128 and the device interior 114. However, in other examples, the cover 200 may include multiple localized magnifying lens portions (Fresnel lens portions—not shown) of relatively small-diameter (e.g., preferably less than 0.5 inch diameter) at spaced locations around the cover upper portion 216 and either integrated into the cover 200 or adhesively bonded to appropriately-sized holes (not shown) formed in the cover 200. In still further examples not shown, the cover 200 may be opaque and the viewing of the figurine 128 may be limited to viewing the device interior 114 on the display screen 420 of an electronic device 400 to which the sculpture device 100 is removably attached via the device attachment clip 300.

Figure 5:
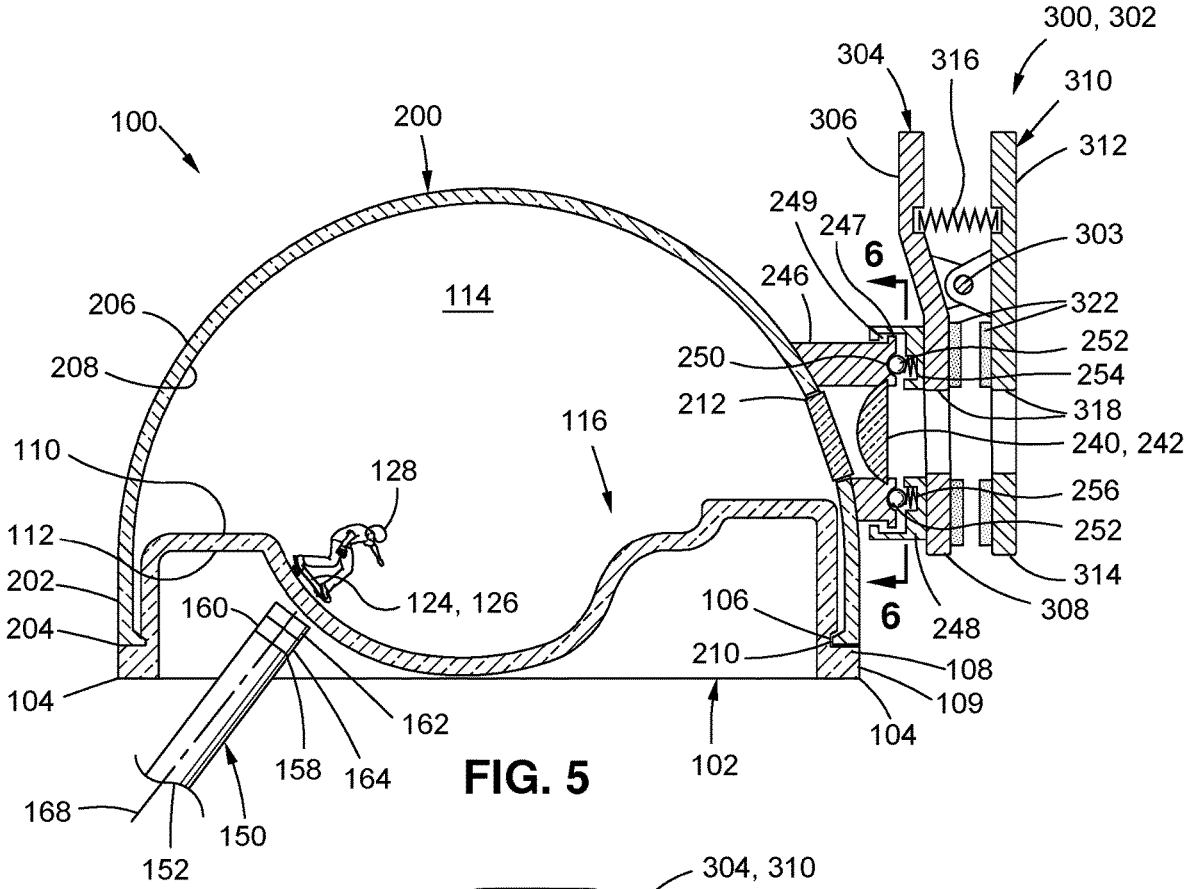
FIG. 5 is a sectional view of the sculpture device taken along line 5 of FIG. 4.

As shown in FIG. 5, the cover 200 has a cover inner surface 208, a cover outer surface 206 and a cover side portion 202 having a cover lower edge 204. The cover lower edge 204 may include an annular lip 210. The base 102 has a base side surface 108 and a base perimeter edge 104. The base perimeter edge 104 may include an annular groove 106 sized and configured to receive the annular lip 210 for retaining the cover to the base 102 at a cover-base interface 219. The base side portion 109 and the cover side portion 202 may each be cylindrical to allow the cover 200 to be rotated (e.g., 360 degrees) relative to the base 102 as shown in FIG. 1.

In some examples, the base side surface 108 may be continuous with the cover outer surface 206 at the cover-base interface 219 to allow for smooth sliding movement of the free end 158 of the control element 150 over the cover-base interface 219. The cover-base interface 219 may be continuous in the sense that the cover-base interface 219 is devoid of any significant (e.g., greater than 0.030 inch) differences in height between the base side surface 108 and the cover outer surface 206. In addition, the cover-base interface 219 may be devoid of significant gaps (e.g., larger than 0.010 inch) between the base side surface 108 and the cover lower edge 204 that would otherwise prevent smooth uninhibited and/or sliding movement of the free end 158 of the control element 150 across the cover-base interface 219. In addition, the base perimeter edge 104 may be generally rounded or radiused to allow for smooth movement of the free end 158 of the control element 150 when moving the control element 150 between the base side surface 108 and the cover outer surface 206.

The smooth continuous configuration of the cover-base interface 219 and the rounded base perimeter edge 104 may allow the magnetic mechanism 160 of the control element 150 to slide smoothly and thereby allow for correspondingly smooth transitional movement of the figurine 128 from the upper surface 110 of the base 102 to the cover inner surface 208 of the cover 200 in the area above the base 102. The control element 150 may be rotated using the fingers and thumb of the user or operator 166 to cause the figurine 128 to twist or spin or perform other maneuvers while the figurine 128 is held against the cover inner surface 208 by the control element 150. For covers 200 that are transparent, movement of the control element 150 along the cover outer surface 206 (e.g., above the upper surface 110 of the base 102) may give the impression that the figurine 128 is performing aerial maneuvers when viewed through the through-hole 258 or the sculpture lens 240. The movements of the figurine 128 including simulated aerial maneuvers may be viewed and/or recorded as images or video using the built-in camera of the electronic device 400 (e.g., cell phone 402).

The upper surface 110 of the base 102 may be configured to represent an environment that corresponds to the configuration of the figurine 128. In the presently-disclosed example of the sculpture device 100, the environment is configured as an empty swimming pool 116 and the figurine 128 is representative of an individual on a skateboard 126. However, the figurine 128 may be provided as a scaled version (e.g., a relatively small scale of 1/300 to 1/100) of a human (e.g., boy, girl, man, woman) or an animal or other creature. The figurine 128 may be a rigid toy figure or the figurine 128 may be an action figure that is bendable or which has articulable joints. For example, a figurine 128 of a human may include bendable or movable joints at the neck, shoulders elbows, wrists, waist, knees and/or ankles. Prior to moving the figurine 128 within the sculpture device 100 using the control element 150, the figurine 128 may be placed in any one of a variety of poses by manually adjusting one or more of the movable joints of the figurine 128.

The upper surface 110 of the base 102 may be configured as a miniaturized replica of an environment typically associated with the type of activities associated with or performed by the type of figurine 128. The figurine 128 may be manually moved along the upper surface 110 and/or the cover inner surface 208 via manually-controlled movement of the control element 150 along the lower surface 112 of the base 102 and/or cover outer surface 206. The figurine 128 may include a support member 124 having a strip of magnetically attractable material mounted to the strip. In the example shown, the support member 124 may be configured as a skateboard 126. In some examples, the support member 124 may be omitted, and the strip of magnetically attractable material may be attached directly to the figurine 128.

The figurine 128 and the upper surface 110 of the base 102 and or portions of the cover 200 may be configured to represent any one of a variety of different types of activities including, but not limited to, surfing and snowboarding. In the example shown, the upper surface is configured as an empty pool 116. In addition, the upper surface 110 may include a bench or platform 122 at one or more locations around the pool 116, and/or steps 120 leading into the pool 116 and the upper surface 110 may include additional features over or onto which the figurine 128 may perform maneuvers such as hops and/or spins when moving along or over such features. However, the figurine 128, the support member 124, and the upper surface 110 may be provided in any one of a variety of different configurations. For example, the support member 124 may be configured as a surfboard for an example of the sculpture device 100 in which the upper surface 110 of the base 102 is configured as an ocean wave (not shown) and the figurine 128 is configured as a surfer (not shown). In a still further example, the support member 124 may be configured as a snowboard for an example in which the upper side of the base 102 is configured as a snowboard park and the figurine 128 is configured as an individual riding the snowboard. In still further examples, the sculpture device 100 may be configured to represent team sports such as baseball, basketball, and football, motorsports such as freestyle motocross, a monster truck rally, or any one of a variety of other types of activities.

In FIGS. 1-5, the control element 150 has a magnetic mechanism 160 that is magnetically attractable to the figurine 128 for retaining the figurine 128 against the upper surface 110. As mentioned above, movement of the magnetically attractable material along the lower surface 112 causes corresponding movement of the figurine 128 along the upper surface 110. In the example shown, the control element 150 is configured as an elongate shaft 152 having a longitudinal axis 168. The sculpture device 100 may include a tether 156 for tethering the control element 150 to the base 102. The shaft 152 may be ergonomically configured to be grasped and manipulated by an operator 166. For example, the shaft 152 may include a concave or necked-down portion to facilitate an operator 166 grasping the shaft 152 using a thumb and forefinger.

The magnetic mechanism 160 may be mounted to a free end 158 of the shaft 152. The magnetic mechanism 160 may be provided as one or more magnets. For example, the magnetic mechanism 160 may be provided as a pair of magnets mounted for controlling the orientation of the figurine 128 in addition to translating the figurine 128. For example, the magnetic mechanism 160 may include a first magnet 162 and a second magnet 164 mounted on the free end 158 of the shaft 152. The first magnet 162 and second magnet 164 may be mounted in a manner such that rotation of the shaft 152 about the longitudinal axis 168 results in a change in the orientation of the figurine 128. For example, an operator 166 holding the shaft 152 between a thumb and forefinger and twisting the shaft 152 about the longitudinal axis 168 may cause rotation of the figurine 128. As an alternative to a shaft 152, the control element 150 may be adapted to be worn on an operator's 166 finger. For example, the control element 150 may be configured as a ring (not shown) that may be worn on a finger of the operator 166 and which may be moved along the lower surface 112 of the base 102 to cause corresponding movement of the figurine 128 along the upper surface 110 of the base 102.

Referring still to FIGS. 1-5, as mentioned above, the sculpture device 100 includes a device attachment clip 300 configured for removably coupling the sculpture device 100 to an electronic device 400 having a built-in camera 422 and a camera lens 424. In the presently-disclosed examples, the electronic device 400 may be a portable communications device such as a cell phone 402, a smartphone, or a mobile phone. For example, the cell phone 402 may be an iPhone™ available from Apple, Inc., of Cupertino, Calif., or the cell phone 402 may be an android phone such as a Galaxy model available from Samsung Corporation of San Jose, Calif. However, in other examples not shown, the electronic device 400 may be a video camera or a camera having video-recording capability. In still further examples, the electronic device 400 may be a portable computing device such as a laptop computer, a tablet computer, a personal digital assistant, or an electronic notebook. The electronic device 400 may also be a non-portable electronic device 400 such as a desktop computer having a camera, or any other type of electronic device 400 having a built-in camera 422 and a camera lens 424.

As mentioned above, the device attachment clip 300 has either a through-hole 258 or a sculpture lens 240. The sculpture lens 240 may be configured as a wide-angle lens 242 and may include a magnifying lens (not shown). The sculpture lens 240 may have a field of view encompassing the width of the device interior 114 to enable the viewing of the movement of the figurine 128 along the upper surface 110 of the base 102 by looking through the sculpture lens 240. In addition, the device attachment clip 300 may be configured such that when the device attachment clip 300 is not mounted to an electronic device 400, an operator 166 may view the device interior 114 through the through-hole 258 or the sculpture lens 240 by looking through a transparent portion 320 or an opening 318 formed in the device attachment clip 300. As shown in FIGS. 3 and 5, the transparent portion 320 or opening 318 may be formed in the first end portion 308 and/or in the second end portion 314 of the device attachment clip 300. Each transparent portion 320 or opening 318 may be aligned with the through-hole axis 260 or sculpture lens axis 244 of the sculpture lens 240. In an example not shown, the sculpture lens 240 may be directly mounted to the cover 200. For example, the sculpture lens 240 may be directly mounted within an aperture 212 formed in the cover 200 (e.g., in the cover side portion 202). In an alternative example shown in FIGS. 17-19 and described in greater detail below, the sculpture lens 240 may be non-directly-attached to the cover 200, and may instead be mounted to the device attachment clip 300 which may be coupled to another location on the cover 200.

In FIGS. 1-5, the sculpture lens 240 is shown integrated into the device attachment clip 300. The device attachment clip 300 may be fixedly coupled to the cover 200 directly (e.g., to the cover lower portion 218). The sculpture lens 240 may be positioned relative to the cover 200 such that the sculpture lens 240 is aligned with the aperture 212 optionally formed in the cover 200. In some examples, the aperture 212 may be filled by a planar transparent piece of plastic or glass to seal the device interior 114 and prevent the figurine 128 from falling out of the sculpture device 100 through the aperture 212. In some examples, the above-mentioned magnifying lens may be installed in the aperture 212 in alignment with the sculpture lens 240.

As mentioned above, the device attachment clip 300 is configured to be removably attached to an electronic device 400. For example, the device attachment clip 300 may be configured to mechanically clamp onto the electronic device 400. However in other examples not shown, the device attachment clip 300 may be configured to be magnetically attached to an electronic device 400. As mentioned above, the electronic device 400 (e.g., a cell phone 402 or smart phone) has a built-in camera 422 or a camera that is attached to or integrated into the electronic device 400.

In some examples, the electronic device 400 (e.g., cell phone 402) may have a generally flat shape or slightly curved shape defined by a front face 404 and a back face 406. The electronic device 400 may have four (4) side edges 410 including two (2) lateral edges 412 and two (2) end edges 414. The end edges 414 may include an upper edge 416 and a lower edge 418. The electronic device 400 may have a rectangular shape. In addition, the front face 404 may have a display screen 420, and the back face 406 may incorporate the camera lens 424. However, in some examples, the device attachment clip 300 may be configured to be mounted to an electronic device 400 having a camera lens 424 integrated into the display screen 420 and/or the electronic device 400 may include a camera lens 424 incorporated into the front face 404 as a component separate from the display screen 420. In this regard, the device attachment clip 300 may be configured to be mounted to an electronic device 400 of any size, shape, or configuration.

For certain electronic devices 400 such as a cell phone 402 or smart phone, the display screen 420 may occupy a substantial portion (e.g., up to 90 percent or more) of the front face 404. In some examples, the device attachment clip 300 may be configured to be mounted to a cell phone 402 or smart phone that is at least partially encased (e.g., on the side edges 410 and the back face 406 of the cell phone 402) by a protective case (not shown) that is open on its front side to allow unobstructed viewing of the display screen 420. The back side of such a protective case may include a small opening that is sized and located complementary to the size and location of the camera lens 424 on the back face 406 of the electronic device 400.

Referring to FIGS. 7-10, regardless of whether or not the electronic device 400 (e.g., cell phone 402) includes a protective case, the device attachment clip 300 may be configured to attach the sculpture device 100 to the electronic device 400 in a manner such that the through-hole 258 or the sculpture lens 240 is aligned with the camera lens 424. As mentioned above, when the built-in camera 422 of the electronic device 400 (e.g., cell phone 402) is activated, the built-in camera 422 may record images or video of the device interior 114 through the through-hole 258 or sculpture lens 240 (e.g., wide-angle lens 242 and/or magnifying lens), allowing the operator 166 to view on the display screen 420 the device interior 114 and the movement of the figurine 128 along the upper surface 110 of the base 102 in correspondence with the operator-controlled or manual movement of the control element 150. In some examples, the device attachment clip 300 may be configured to be mountable onto electronic devices 400 (e.g., cell phones 402) having a device thickness 408 of up to 1.0 inch and, more preferably, a device thickness 408 of between 0.10-1.0 inch, with or without a protective case. However, the device attachment clip 300 may be configured to be mountable onto electronic devices 400 having a device thickness 408 of greater than 1.0 inch or having a device thickness 408 of less than 0.10 inch, with or without a protective case.

Figure 9:
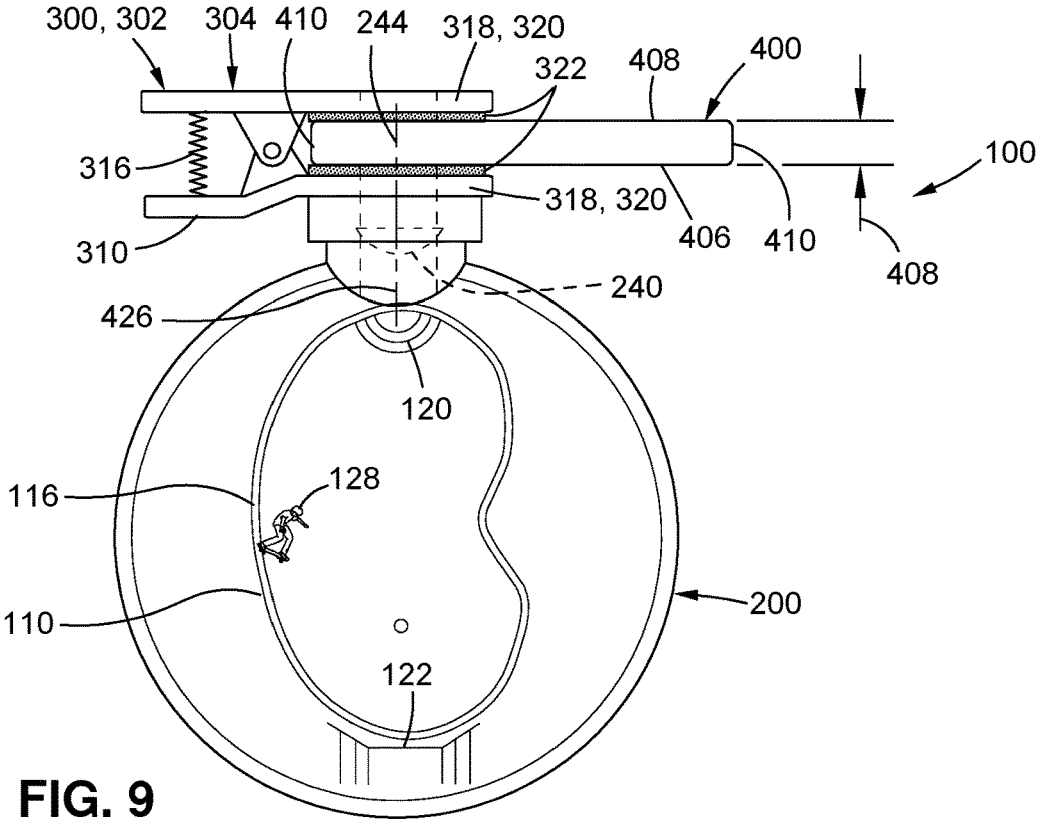
FIG. 9 is a top view of an example of a sculpture device clamped to a cell phone via the device attachment clip.
Figure 10:
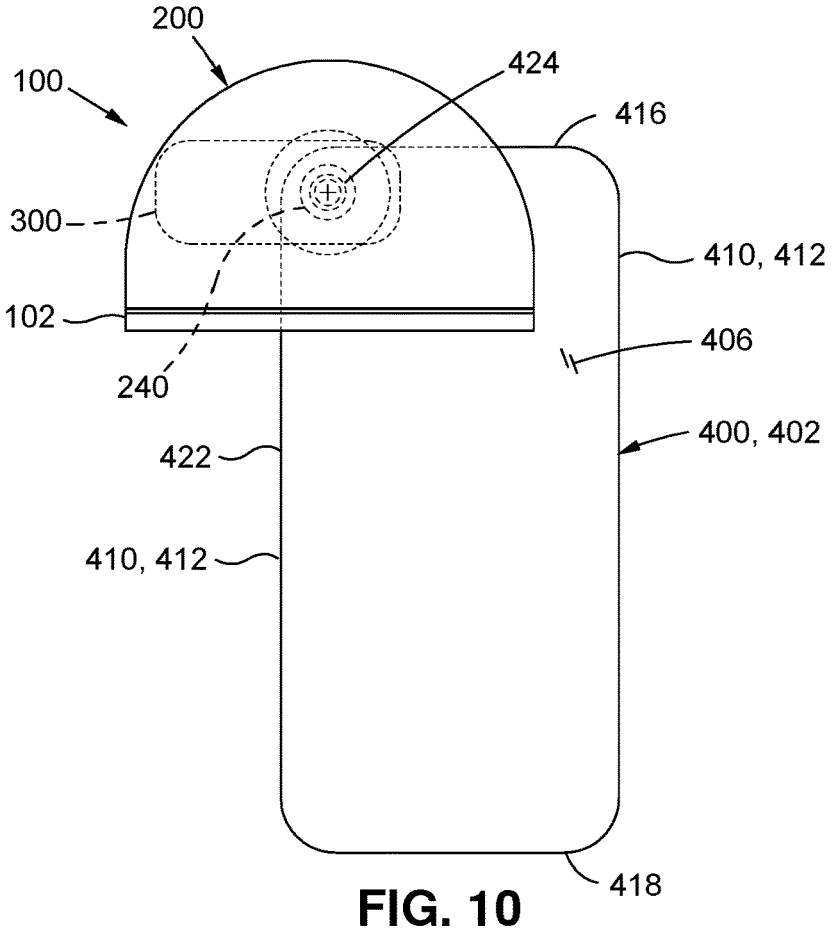
FIG. 10 is a back view of the cell phone showing the sculpture device clamped to the cell phone.
Figure 11:
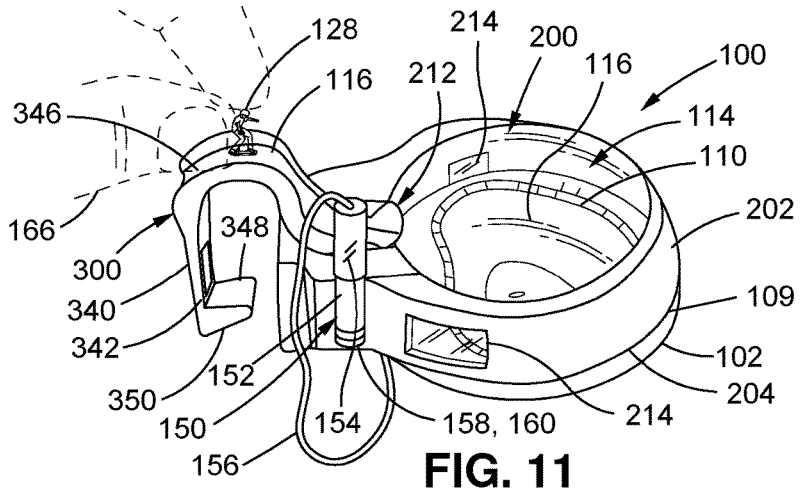
FIG. 11 is a perspective view of a further example of a sculpture device in which the device attachment clip is configured as a static clamp having at least one clamping leg configured to bend outwardly for clamping onto an electronic device such as a cell phone.
Figure 12:
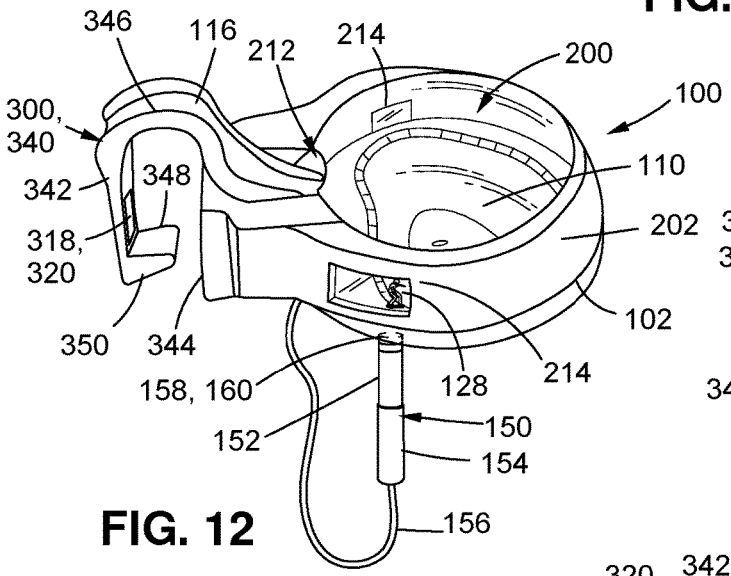
FIG. 12 is a further perspective view of the sculpture device of FIG. 11 showing the control element for moving along the lower surface of the base for causing corresponding movement of the figurine along the upper surface of the base.
Figure 13:
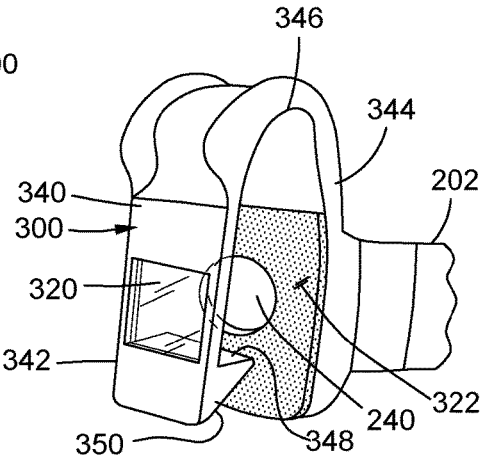
FIG. 13 is a magnified view of an example of the static clamp configuration of the device attachment clip.
Figure 14:
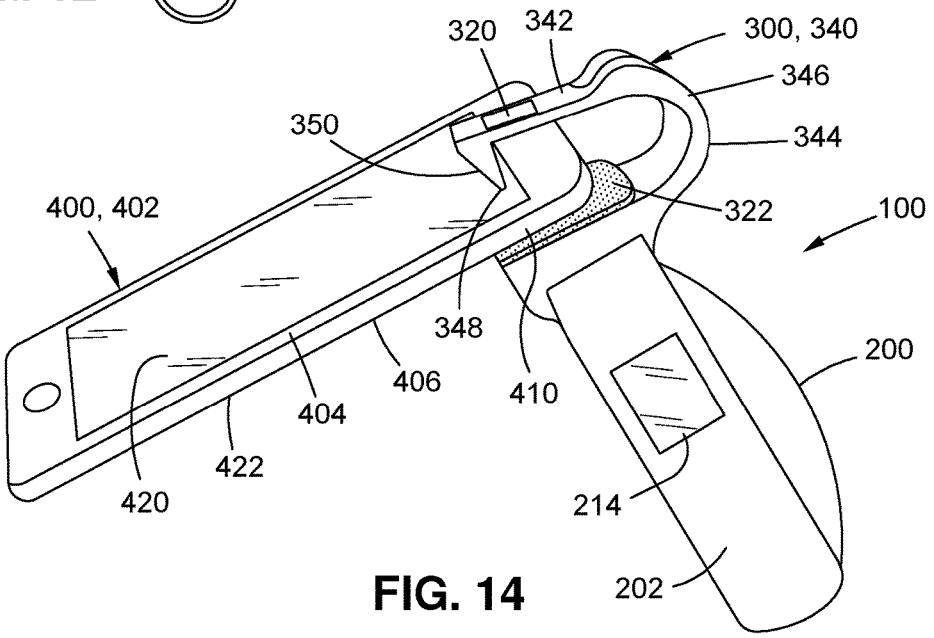
FIG. 14 is a perspective view of the sculpture device of FIGS. 11-13 clamped to a cell phone via the static clamp.

Referring to FIGS. 9-10, some examples of the device attachment clip 300 may be sized and configured to attach the sculpture device 100 to an electronic device 400 (e.g., cell phone 402) for which the camera lens 424 is located at a distance of between 0.25-2.0 inches from one of the side edges 410 (e.g., an upper edge 416 or a lateral edge 412). Such an electronic device 400 may have a width of between 2-5 inches as measured across the lateral side edges 410, and a length of 4-8 inches as measured between the upper edge 416 and lower edge 418. However, in other examples, the device attachment clip 300 may be configured to clamp the sculpture device 100 onto an electronic device 400 in which the camera lens 424 (e.g., the camera lens axis 426) is located at a distance of less than 0.5 inch or greater than 2.0 inch from at least one of the side edges 410.

Referring generally to the example of the sculpture device 100 shown in FIGS. 1-10 and specifically to FIG. 5, the device attachment clip 300 may be configured as a lever assembly 302 having a first lever 304 and a second lever 310 pivotally interconnected about a lever-pivot axis 303. The first lever 304 may include a first handle portion 306 and first end portion 308. The second lever 310 may include a second handle portion 312 and a second end portion 314. The second handle portion 312 may bent slightly toward the cover 200 and the first handle portion 306 may be generally straight to avoid interfering with the operator's 166 face when placing the device attachment clip 300 proximate the eye of the operator 166 for viewing through the through-hole 258 or the sculpture lens 240, as shown in FIG. 1. The first handle portion 306 and the second handle portion 312 may both be located on a side of the lever-pivot axis 303 opposite the first end portion 308 and the second end portion 314. The sculpture lens 240 may be coupled to the first end portion 308. The first end portion 308 may be coupled to the cover 200. For example, the first end portion 308 may be adhesively bonded, mechanically fastened, or integrally formed with the cover 200.

As shown in FIG. 5, the lever assembly 302 may include a biasing member 316 for biasing the first end portion 308 of the first lever 304 and the second end portion 314 of the second lever 310 toward each other for clamping engagement of the sculpture device 100 onto the electronic device 400. For example, the first end portion 308 and the second end portion 314 may clamp onto the front face 404 and back face 406 of the electronic device 400. Although shown as a compression spring positioned between the first handle portion 306 and the second handle portion 312, the biasing member 316 may be provided in any one of a variety of alternative configurations, including a leaf spring (not shown) positioned between the first handle portion 306 and second and a portion, a tension spring (not shown) positioned between the first end portion 308 and second end portion 314, or any one of a variety of other biasing member configurations.

In any one of the examples disclosed herein, the lever assembly 302 or static clamp 340 (FIGS. 11-16) may be configured to firmly or snugly clamp the sculpture device 100 onto the cell phone 402 or other electronic device 400 in a manner preventing the sculpture device 100 from moving or slipping relative to the electronic device 400. The small size (e.g., less than 3 inches wide and/or less 2 inches tall) and light weight (e.g., less than 16 ounces) of the sculpture device 100 reduces or avoids the risk of the sculpture device 100 slipping relative to the electronic device 400. The snug clamping of the device attachment clip 300 to the electronic device 400 may allow the combination electronic device 400 and sculpture device 100 to be rotated to cause the figurine 128 to move along the upper surface 110 of the base 102 (e.g., without the use of the control element 150) while the built-in camera 422 records the movement of the figurine 128. As mentioned above, the electronic device 400 may have the capability for recording video of the movement of the figurine 128 in high-speed camera mode and which may result in an interesting effect during playback of the video in slow motion to show the movements of the figurine 128. To improve the clamping of the device attachment clip 300 to the electronic device 400, the first end portion 308 and/or the second end portion 314 may include an elastomeric pad 322 configured to frictionally engage the front face 404 and/or back face 406 of the electronic device 400. The elastomeric pad 322 may be a relatively thin (e.g., less than 0.10 inch thick) sheet of foam, rubber, and/or other resiliently elastomeric material.

In FIG. 5, the first end portion 308 and/or the second end portion 314 may include a transparent portion 320 or opening 318 that may be aligned with the through-hole 258 or the sculpture lens 240. The transparent portion 320 may be a thin planar sheet of transparent glass or plastic. Alternatively, the second end portion 314 may include a hole or opening 318. In some examples of the sculpture device 100, one or more of the transparent portions 320 in a device attachment clip 300 may be configured as a magnifying lens. The transparent portion 320 or opening 318 in the first end portion 308 and/or second end portion 314 may allow for line-of-sight viewing through the through-hole 258 or the sculpture lens 240 to allow for viewing of the device interior 114 when the sculpture device 100 is not attached to an electronic device 400. In this manner, an operator 166 may hold the device attachment clip 300 with one hand and view the device interior 114 through the transparent portion 320 or opening 318 and through-hole 258 or sculpture lens 240, while also moving the control element 150 using the opposite hand to move the figurine 128 along the upper surface 110 of the base 102.

Figure 6:
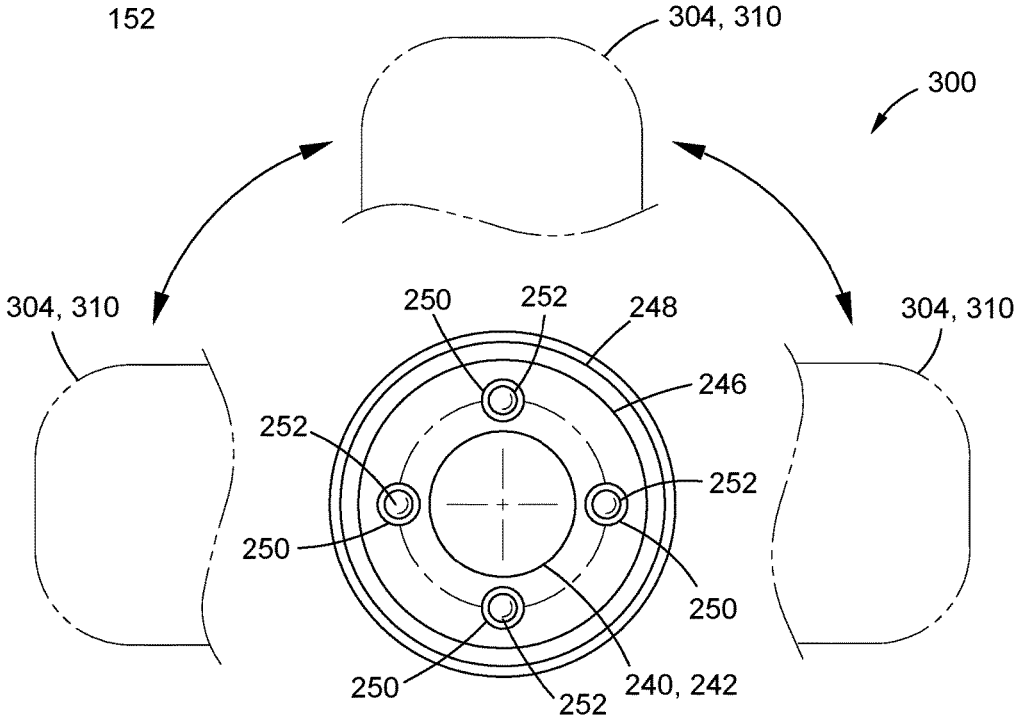
FIG. 6 is a sectional view of a portion of the device attachment clip in an example configured to allow rotation of the device attachment clip about a through-hole axis of a through-hole or a sculpture lens axis of a sculpture lens (e.g., a wide angle lens) of the device attachment clip.

Referring to the example of FIGS. 3, 5-6, the device attachment clip may be configured in a manner allowing the device attachment clip 300 to rotate relative to the cover 200 about the through-hole axis 260 or the sculpture lens axis 244. For example, the device attachment clip 300 may be rotatably coupled to the sculpture lens 240 which may be directly or indirectly coupled to the cover 200. The rotatable configuration may allow the device attachment clip 300 to be rotated about the through-hole axis 260 or the sculpture lens axis 244 as shown in FIG. 6. The ability to rotate the device attachment clip 300 may allow an operator 166 to select between holding the device attachment clip 300 with either the left hand or the right hand while the opposite hand moves the control element 150 for moving the figurine 128 within the device interior 114 while the operator 166 views the device interior 114 through the through-hole 258 or sculpture lens 240 (e.g., via the transparent portion 320 or opening 318) and/or by looking at the device interior 114 through the cover 200. The rotatable configuration of the device attachment clip 300 may also allow the sculpture device 100 to be maintained in a horizontal orientation while orienting the electronic device 400 (e.g., cell phone 402) in either a vertical orientation (e.g., FIG. 10) or in a horizontal orientation (not shown).

In the example of FIGS. 5-6, the device attachment clip 300 may include a lens inner housing 246 and a lens outer housing 248. The lens inner housing 246 may be coupled directly to the cover 200. In addition, the lens inner housing 246 may contain the sculpture lens 240. The lens outer housing 248 may optionally include an annular slot 247 configured to receive an annular protrusion 249 optionally included with the lens inner housing 246 for coupling the lens outer housing 248 to the lens inner housing 246 as shown in FIG. 5. However, the lens inner housing 246 and lens outer housing 248 may include any one of a variety of geometric arrangements for mechanically coupling the lens inner housing 246 to the lens outer housing 248. The lens outer housing 248 may be fixedly coupled to the first end portion 308 of the lever assembly 302.

In some examples of the sculpture device 100, any one of the presently-disclosed examples of the device attachment clip 300 may be configured to releasably lock the device attachment clip 300 at any one of a variety of angular positions. For the example shown in FIGS. 5-6, the device attachment clip 300 may include a plurality or circumferentially spaced recesses 250 and a corresponding plurality of ball elements 252. In the embodiment shown, the end face of the lens inner housing 246 may include a plurality of hemispherically-shaped recesses 250, and the opposing end face of the lens outer housing 248 may include a corresponding plurality of generally cylindrical bores 254 configured to receive a corresponding plurality of ball elements 252. Each one of the bores 254 may include a spring element 256 or other biasing mechanism configured to bias the ball elements 252 into the recesses 250 when angularly aligned with each other.

In the example shown, the device attachment clip 300 includes four (4) recesses 250 and four (4) ball elements 252 to allow for releasably locking of the device attachment clip 300 at 90 degree angular intervals. However, the device attachment clip 300 may be configured to allow for releasable locking at any one of a variety of angular intervals, and is not limited to 90 degree angular intervals. The arrangement of recesses 250, bores 254, spring elements 256 and ball elements 252 allows for maintaining a desired orientation of the sculpture device 100 relative to the electronic device 400 (e.g., cell phone 402) when moving the figurine 128 and viewing such movements on the display screen 420 or by looking directly through the through-hole 258 or sculpture lens 240 or looking through the cover 200. The angular adjustability of the device attachment clip 300 accommodates electronic devices 400 having different locations of the camera lens 424 relative to the side edges 410 of the electronic device 400 in a manner allowing the through-hole axis 260 or the sculpture lens axis 244 to be aligned with the camera lens axis 426 of a camera lens 424 of the built-in camera 422 of the electronic device 400. In addition, when the sculpture device 100 is unattached to an electronic device 400, angular adjustability of the sculpture device 100 allows for the option of holding the device attachment clip 300 by either the left hand or the right hand and using the opposite hand to move the control element 150 for moving the figurine 128.

Referring to FIGS. 11-16, shown is an example of the sculpture device 100 having a cover 200 and a base 102. The base 102 may be rotatably coupled to the cover 200. The device attachment clip 300 is configured as a static clamp 340 which may be coupled to the cover 200. The static clamp 340 has at least one clamping leg that is resiliently bendable or flexible to allow the static clamp 340 to be slidably clamped onto an electronic device 400 such as a cell phone 402. In this regard, the clamping leg may function as a spring capable of bending outwardly when being clamped onto a cell phone 402. In the example shown, the static clamp 340 includes a first clamping leg 342 and a second clamping leg 344 spaced apart from each other and interconnected to each other by a leg connector 346.

The sculpture lens 240 may be mounted within or integrated into the first clamping leg 342 in a manner such that the sculpture lens axis 244 is aligned with the aperture 212 that may be formed in the cover 200. In the example shown, the static clamp 340 may include one or more features over which the figurine 128 may be moved. For example, a pool slide 118 may be integrated into the outer or upper surface 110 of the leg connector 346 and first clamping leg 342. The pool slide 118 may feed into the aperture 212 in the cover 200 to allow the figurine 128 to slide down the pool slide 118, pass through the aperture 212, and enter the device interior 114 which includes an upper surface 110 configured as an empty swimming pool 116. As may be appreciated, any one of a variety of alternative features may be incorporated into the device attachment clip 300 over which the figurine 128 may be moved to enhance the experience of a user using the sculpture device 100.

The first clamping leg 342 has a first end portion 308 and the second clamping leg 344 has a second end portion 314. The first end portion 308 and second end portion 314 may be spaced apart from each other when the static clamp 340 is in a non-mounted state. In the non-mounted state prior to clamping to an electronic device 400, the first end portion 308 and second end portion 314 may define a leg gap that is less than the device thickness 408 of the electronic device 400. As mentioned above, the first clamping leg 342 and/or the second clamping leg 344 may be configured to bend away from each other when slid over an electronic device 400 for clamping onto the front face 404 and back face 406 of the electronic device 400.

The second end portion 314 may include an inwardly protruding ledge 348 having a ramped portion 350 to facilitate the initial engagement and outward bending of the second clamping leg 344 over an electronic device 400 when attaching the static clamp 340 to the electronic device 400. The first end portion 308 and the second end portion 314 may also include a transparent portion 320 (e.g., a plastic or glass window) or an opening 318 aligned with the through-hole 258 or the sculpture lens 240 to allow for line-of-sight viewing through the through-hole 258 or sculpture lens 240 for viewing the device interior 114 of the sculpture device 100 when not attached to the electronic device 400. The transparent portion 320 may optionally be a magnifying lens. The first end portion 308 and/or the second end portion 314 may include an elastomeric pad 322 as described above to enhance frictional engagement of the first end portion 308 and/or second end portion 314 respectively with the front face 404 and/or back face 406 of the electronic device 400.

Referring still to the example of the sculpture device 100 shown in FIGS. 11-14, the cover 200 may include includes a cover side portion 202 that is non-transparent such that the device interior 114 is only visible through the transparent top portion of the cover 200. The cover side portion 202 may optionally include one or more transparent windows 214 at different circumferential locations on the cover side portion 202 and through which an operator 166 may view the device interior 114. In some examples, one or more of the windows 214 may be provided as a wide-angle lens 242 and/or as a magnifying lens. For example, one or more of the windows 214 may be configured as an acrylic magnifying lens providing up to five-times magnification. The windows 214 provide the operator 166 with the ability to view the movement of the figurine 128 from one or more locations on the sides of the sculpture device 100.

Figure 17:
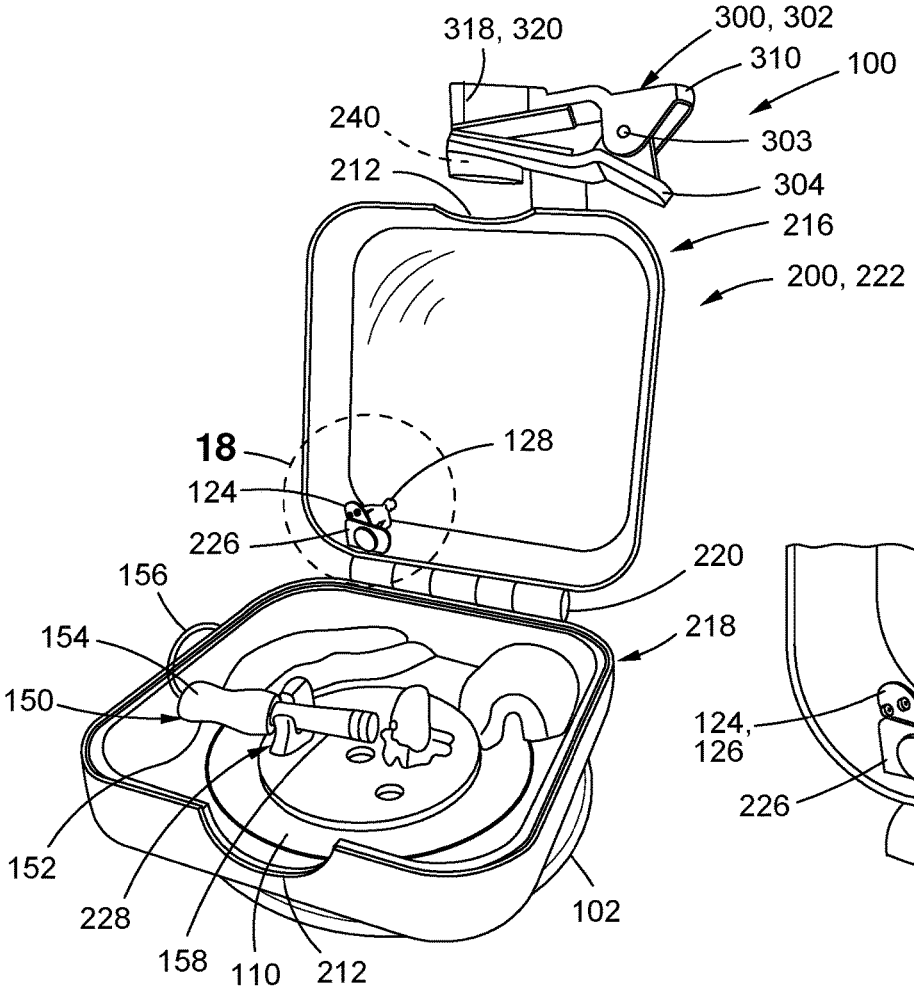
FIG. 17 is a perspective view of a further example of a sculpture device in which the cover comprises a cover upper portion movably coupled to a cover lower portion and showing the cover upper portion in an open position.
Figure 18:
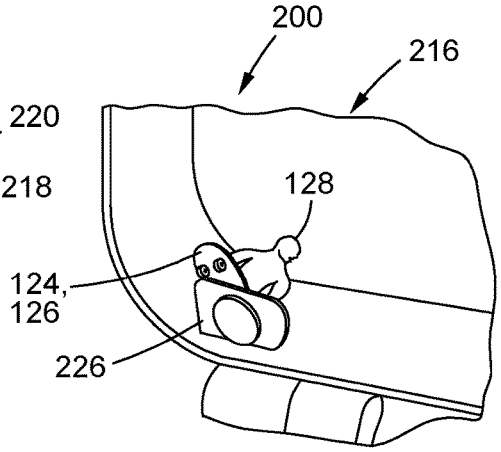
FIG. 18 is a magnified view of the portion of FIG. 17 identified by reference numeral 18 and illustrating a figurine mounting fixture coupled to the cover upper portion for holding the figurine when not in use.
Figure 19:
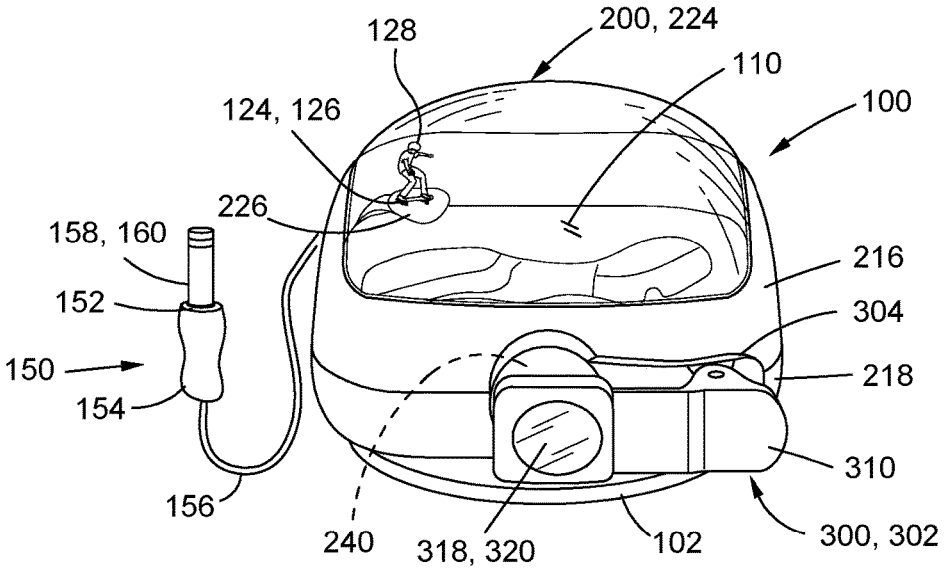
FIG. 19 is a perspective view of the sculpture device of FIGS. 17-18 showing the cover upper portion in a closed position.

Referring to FIGS. 17-19, shown is an example of the sculpture device 100 wherein the cover 200 is made up of a cover lower portion 218 and a cover upper portion 216. The base 102 may be coupled to the cover lower portion 218. In some examples, the base 102 including the upper surface 110 may be rotatable relative to the cover lower portion 218. The cover upper portion 216 may be pivotably coupled to one side of the cover lower portion 218. In one example, the cover upper portion 216 may be movable between a closed position 224 (FIG. 19) and an open position 222 (FIG. 17) in a clamshell arrangement. For example, the cover upper portion 216 may be coupled to the cover lower portion 218 by a hinge element 220 such as a mechanical hinge or a living hinge formed of a resiliently bendable piece of material. Alternatively, the cover upper portion 216 may be non-hingedly coupled to the cover lower portion 218 but may be removable from the cover lower portion 218.

In the closed position 224 shown in FIG. 19, the cover upper portion 216 and the cover lower portion 218 collectively enclose the device interior 114. In the closed position 224, the cover upper portion 216 may be configured to be releasably locked to the cover upper portion 216 via one or more mechanical features (not shown). For example, the cover upper portion 216 and/or the cover lower portion 218 may include one or more lip 210*s*, grooves, snaps, or other mechanical features on one or mores locations (e.g., sides) of the cover 200 for releasably locking the cover upper portion 216 to the cover lower portion 218 in the closed position 224.

When the cover upper portion 216 is in the open position 222 as shown in FIG. 17, the device interior 114 may be exposed allowing access to the figurine 128 and the upper surface 110 of the base 102. When the cover upper portion 216 is in the closed position 224 and secured to the cover lower portion 218, the cover upper portion 216 and cover lower portion 218 may collectively define a cover 200 having a generally square shape with rounded corners as shown in FIGS. 17-19. However, the cover upper portion 216 and cover lower portion 218 in the closed position 224 may be configured to result in a generally rounded disc shape or a dome shape. As may be appreciated, the cover upper portion 216 and cover lower portion 218 may be configured in any one of a variety of alternative shapes and configurations, without limitation.

In FIGS. 17-19, when the sculpture device 100 is not in use, the control element 150 and/or the figurine 128 may be securely stored within the device interior 114. For example, the cover lower portion 218 and/or the cover upper portion 216 may include one or more figurine mounting fixtures 226 configured to hold a corresponding quantity of figurines 128 when not in use. In the example shown, the figurine mounting fixtures 226 may be located in the corners of the cover upper portion 216. Alternatively or additionally, the cover lower portion 218 and/or the cover upper portion 216 may include a control element mounting fixture 228 configured to hold the control element 150 when not in use. In the example shown, the control element 150 may be mounted to the upper surface 110 of the base 102. The figurine mounting fixtures 226 and the control element mounting fixture 228 may provide a means for non-movably securing the control element 150 and one or more figurines 128 in position within the sculpture device 100 when the cover upper portion 216 is in the closed position 224 and thereby prevent free movement (e.g., rattling around) of the control element 150 and the figurines 128 within the device interior 114 when the cover upper portion 216 is in the closed position 224.

The one or more figurine mounting fixtures 226 may each be configured as a mechanical clamp, a shelf and/or as a magnet configured to magnetically secure the one or more figurines 128. The one or more figurine mounting fixtures 226 may be adhesively bonded or mechanically coupled to the inner surface of the cover upper portion 216. Alternatively, the figurine mounting fixtures 226 may be secured to the cover lower portion 218 or to the upper surface 110 of the base 102. The cover upper portion 216 may include a plurality of figurine mounting fixtures 226 each configured to hold a different figurine 128 each representing a different character, and thereby allowing for substitution of different figurines 128 when using the sculpture device 100. The control element mounting fixture 228 may comprise a mechanical clamp or a magnet mounted to the upper surface 110 of the base 102 or to the cover inner surface 208.

In the example of FIGS. 17-19, the device attachment clip 300 is shown coupled to the cover upper portion 216. The device attachment clip 300 is configured as a lever assembly 302 having a first lever 304 and a second lever 310 as described above. However, in an embodiment not shown, the device attachment clip 300 be configured as a static clamp 340 similar to the example shown in FIGS. 11-14. In FIGS. 17-19, the through-hole 258 or sculpture lens 240 may be included with the first lever 304 in a manner similar to that which is described above with regard to the example of FIGS. 1-10. The first lever 304 may be coupled to the cover upper portion 216. However, in other examples not shown, the device attachment clip 300 may be configured such that the first lever 304 is coupled to the cover lower portion 218. The device attachment clip 300 may be configured such that the sculpture lens 240 is aligned with an aperture 212 that may be formed in the cover upper portion 216 and/or in the cover lower portion 218. The aperture 212 may be located on a side of the cover lower portion 218 opposite the hinge element 220. In the example of FIGS. 17-19, one-half of the aperture 212 is formed in the cover upper portion 216 and the remaining one-half of the aperture 212 is formed in the cover lower portion 218.

As mentioned above, the present disclosure describes the sculpture device 100 in the context of a figurine 128 configured to represent an individual on a skateboard 126 movable along an upper surface 110 representing an empty swimming pool 116. However, the figurine 128 and the upper surface 110 of the base 102 may be configured to represent any one of a variety of different types of actors and the upper surface 110 of the base 102 may be configured to represent any one of a variety of different types of scenes or environments. For example, the figurine 128 may be configured as a skateboarder or a freestyle bicyclist, and the upper surface 110 of the base 102 may be configured as a skateboard park, a half pipe, a quarter pipe, a vert ramp, or any one of a variety of other environments. In still further examples, the figurine 128 may be configured to represent an individual on a surfboard and the upper surface 110 may be configured to represent a curling wave of an ocean. In still further examples, the figurine 128 may be configured as a monster truck and the upper surface 110 of the base 102 may be configured as a monster truck obstacle course.

In some examples not shown, the figurine may be made up of one or more body portions. Each one of the body portions may include a figurine surface configured to receive a body sticker (e.g., a decal or an applique). Each body sticker may be shaped and sized complementary to the figurine surface on which it is to be applied. Each body sticker may have an attachment side and an image side. The attachment side may have a low-tack pressure-sensitive adhesive or electrostatic-cling capability for removably attaching or permanently attach the body sticker to the figurine surface. The body stickers may be configured as peel-and-stick type body stickers supported on a carrier sheet. The body stickers may be removable from the carrier sheet for application onto one or more of the figurine surfaces The image side of each body sticker may contain a graphic or an image. In one example, the image side of a body sticker may contain graphics representing any one of a variety of characters including human characters such as a boy, a girl, a man, or a woman. The body sticker may contain graphics representing an entirety of the character such as the legs, torso, arms, neck, and head of a human character. Alternatively, a body sticker may contain graphics resenting only portion of a human character such as a human head or a human face. In one example, a plurality of body stickers may be provided with the sculpture device. Each one of the body stickers may have a unique facial configuration including a unique arrangement of the eyes, ears, nose, and mouth of a human face. Alternatively or additionally, a body sticker may contain graphics of the hair of a human head. In still further examples, a body sticker may contain graphics representing non-human creatures such as animals or fictional characters. In even further examples, a body sticker may include a logo, a trademark, a symbol, an emblem, a flag, or any one of a variety of other types of images and/or markings for applying to one or more figurine surfaces.

A figurine may have a two-dimensional shape or a three-dimensional shape. As an example of a three-dimensional shape, the figurine may have a shape that resembles a human body such as in FIG. 2. Alternatively, in examples not shown, a figurine may have a box-like shape containing five (5) figurine surfaces including a front surface, a back surface, two opposing sides surface, and a top surface, each of which may receive a body sticker having graphics corresponding to the location of the surface on the human body. For example, a figurine may have a box-like shape having figurine surfaces each configured to receive a body sticker representing one side of a human head. A body sticker of a human face may be applied to the front surface of the figurine, and a body sticker of human ears and hair may be applied to each of the opposing side surfaces of the figurine. Body stickers of human hair may be applied to each of the top surface and the back surface of the figurine.

In other examples, a figurine may have a two-dimensional generally flat and relatively thin shape having two opposing figurine surfaces each configured receive a body sticker. For example, the figurine may include a front figurine surface and a back figurine surface. In one example, a two-dimensional figurine may be shaped and configured to represent the profile shape of a human head when viewed from the front. Alternatively, a two-dimensional figurine may be shaped and configured to represent the profile shape of a human head when viewed from the side. Regardless of the configuration, the head portion may be configured to receive body stickers having graphics representing a human head. As may be appreciated, the figurine and the body stickers may be provided in any one of a variety of sizes, shapes, and configurations, without limitation.

In some examples not shown, the sculpture device 100 may also be configured in the context of team sports. For example, the upper surface 110 of the base 102 may be configured to represent a stadium or an athletic field and the sculpture device 100 may include a plurality of figurines 128 representing the members of opposing teams. The team sports may include any one of a variety of different sports such as baseball, basketball, football, soccer and other sports. In any one of the above-described sculpture device 100 examples, the upper surface 110 of the base 102 and/or the cover inner surface 208 of the cover 200 may be configured to represent a spectator seating area surrounding the portion of the upper surface 110 over which the figurines 128 are moved. As described above, the figurines 128 may be movable along the upper surface 110 in response to movement of one or more control elements 150 that may be included with the sculpture device 100.

Additional modifications and improvements of the present disclosure may be apparent to those of ordinary skill in the art. Thus, the particular combination of parts described and illustrated herein is intended to represent only certain embodiments of the present disclosure and is not intended to serve as limitations of alternative embodiments or devices within the spirit and scope of the disclosure.

What is claimed is:

1. A sculpture device removably attachable to an electronic device having a built-in camera, a camera lens, and a display screen, comprising:

a base having a lower surface and an upper surface;

a figurine movable along the upper surface;

a control element having a magnetic mechanism magnetically attractable to the figurine for retaining the figurine against the upper surface and moving the figurine along the upper surface in correspondence with manual movement of the control element along the lower surface;

a cover coupled to the base and enclosing a device interior of the sculpture device; and a device attachment clip coupled to the cover and having one of a through-hole and a sculpture lens, the device attachment clip configured to removably attach the sculpture device to the electronic device in a manner such that the through-hole or sculpture lens is aligned with the camera lens thereby allowing an operator to view the figurine and the device interior on the display screen when the camera is activated.

2. The sculpture device of claim 1, wherein:

the device attachment clip is configured to clamp onto the electronic device having a device thickness ranging from 0.10-1.0 inches and having the camera lens located at a distance of 0.25-2.0 inches from a side edge of the electronic device.

3. The sculpture device of claim 1, wherein the device attachment clip comprises a lever assembly, including:

a first lever and a second lever pivotally interconnected about a lever-pivot axis and respectively, the first lever having a first handle portion and first end portion, the second lever having a second handle portion and a second end portion, the through-hole or the sculpture lens being included with the first end portion, the first end portion being coupled to the cover; and a biasing member for biasing the first end portion of the first lever and the second end portion of the second lever toward each other for clamping engagement of the sculpture device onto the electronic device.

4. The sculpture device of claim 1, wherein the device attachment clip comprises a static clamp, including:

at least one clamping leg being resiliently bendable for clamping the sculpture device onto a front face and a back face of the electronic device.

5. The sculpture device of claim 1, wherein:

the through-hole has a through-hole axis;

the sculpture lens has a sculpture lens axis; and the device attachment clip is configured in a manner allowing the device attachment clip to rotate relative to the cover about one of the through-hole axis or the sculpture lens axis.

6. The sculpture device of claim 5, wherein the device attachment clip includes:

a lens inner housing and a lens outer housing; and a plurality or circumferentially spaced recesses and a corresponding plurality of ball elements biased into the recesses when the ball elements are angularly aligned with the recesses.

7. The sculpture device of claim 1, wherein:

the cover has a cover inner surface, a cover outer surface, and a cover side portion having a cover lower edge;

the base has a base side surface and a base perimeter edge; and the cover lower edge being coupled to the base perimeter edge at a cover-base interface; and the base side surface being continuous with the cover outer surface at the cover-base interface to allow smooth sliding movement of the control element over the cover-base interface.

8. The sculpture device of claim 1, wherein:

the cover has an annular lip; and the base has an annular groove sized and configured to receive the lip for rotatably coupling the cover to the base.

9. The sculpture device of claim 1, wherein:

the cover comprises a cover lower portion and a cover upper portion;

the cover lower portion coupled to the base; and the cover upper portion removably coupled to the cover lower portion and movable between a closed position and an open position exposing the device interior of the sculpture device.

10. The sculpture device of claim 9, wherein:

the device attachment clip is coupled to the cover lower portion.

11. The sculpture device of claim 9, wherein:

the cover upper portion is hingedly coupled to the cover lower portion via a hinge element; and the device attachment clip is located on a side of the cover lower portion opposite the hinge element.

12. The sculpture device of claim 9, wherein at least one of the cover lower portion and the cover upper portion includes at least one of the following:

a figurine mounting fixture configured to hold the figurine and prevent movement when not in use; and a control element mounting fixture configured to hold the control element and prevent movement when not in use.

13. The sculpture device of claim 1, wherein:

the cover has one or more windows through which the operator may view the upper surface and the figurine.

14. The sculpture device of claim 13, wherein:

at least one of the windows is a wide-angle lens and/or a magnifying lens.

15. The sculpture device of claim 1, wherein:

the control element comprises an elongate shaft configured to be grasped by the operator and having a free end supporting the magnetic mechanism.

16. The sculpture device of claim 15, wherein:

the magnetic mechanism comprises first and second magnets mounted on the free end in a manner such that rotation of the shaft about the longitudinal axis results in a change in the orientation of the figurine.

17. A sculpture device removably attachable to a cell phone having a built-in camera, a camera lens, and a display screen, comprising:

a base having a lower surface and an upper surface;

a figurine movable along the upper surface;

a control element having a magnetic mechanism magnetically attractable to the figurine for retaining the figurine against the upper surface and moving the figurine along the upper surface in correspondence with movement of the control element along the lower surface;

a cover rotatably coupled to the base and having a sculpture lens configured as a wide-angle lens mounted to the cover; and a device attachment clip coupled to the cover and having a sculpture lens configured as a wide-angle lens, the device attachment clip configured to removably attach the sculpture device to the cell phone such that the sculpture lens is aligned with the camera lens allowing an operator to view the figurine and the device interior on the display screen when the camera is activated.

18. The sculpture device of claim 17, wherein:

the device attachment clip is configured to clamp onto the cell phone having a device thickness ranging from 0.10-1.0 inches and having the camera lens located at a distance of 0.25-2.0 inches from a side edge of the cell phone.

19. A sculpture device removably attachable to a cell phone having a built-in camera, a camera lens, and a display screen, comprising:

a base having a lower surface and an upper surface;

a figurine movable along the upper surface;

a control element having a magnetic mechanism magnetically attractable to the figurine for retaining the figurine against the upper surface and moving the figurine along the upper surface in correspondence with movement of the control element along the lower surface;

a cover coupled to the base and enclosing a device interior of the sculpture device;

a sculpture lens configured as a wide-angle lens coupled to the cover; and a device attachment clip coupled to the sculpture lens and configured to removably attach the sculpture device to the cell phone such that the sculpture lens is aligned with the camera lens allowing an operator to view the figurine and the device interior on the display screen when the camera is activated.

20. The sculpture device of claim 19, wherein:

the device attachment clip is configured to clamp onto the cell phone having a device thickness ranging from 0.10-1.0 inches and having the camera lens located at a distance of 0.25-2.0 inches from a side edge of the cell phone.

* * * * *